US008297952B2

(12) United States Patent
Wu

(10) Patent No.: US 8,297,952 B2
(45) Date of Patent: Oct. 30, 2012

(54) WATER INLET UNIT FOR AN AMPHIBIOUS PUMP

(76) Inventor: Cheng-Kuan Wu, Dashe Township, Kaohsiung County (TW)

( * ) Notice: Subject to any disclaimer, the term of this patent is extended or adjusted under 35 U.S.C. 154(b) by 297 days.

(21) Appl. No.: 12/833,194

(22) Filed: Jul. 9, 2010

(65) Prior Publication Data

US 2012/0006423 A1 Jan. 12, 2012

(51) Int. Cl.
*F04B 39/00* (2006.01)

(52) U.S. Cl. ..... 417/423.3; 417/423.1; 417/423.9; 417/238; 137/565.01; 137/550; 137/269; 137/271

(58) Field of Classification Search ..... 137/565.01, 137/550, 269, 271, 545; 417/423.1, 423.3, 417/423.9, 238
See application file for complete search history.

(56) References Cited

U.S. PATENT DOCUMENTS 1,909,578 A * 5/1933 Franke ..... 417/61
3,631,880 A * 1/1972 Hansel ..... 137/172
3,748,066 A * 7/1973 Sully et al. ..... 417/423.3
3,785,537 A * 1/1974 Appleby et al. ..... 222/464.2
3,785,752 A * 1/1974 Crespo ..... 417/319
3,945,771 A * 3/1976 Arakawa ..... 417/423.3
4,218,195 A * 8/1980 Shure ..... 417/411
4,230,440 A * 10/1980 Niedermeyer ..... 417/423.15
4,685,868 A * 8/1987 Bodensteiner et al. ..... 417/405
4,786,239 A * 11/1988 Eberhardt ..... 417/238
4,966,534 A * 10/1990 Hasslen, III ..... 417/423.3
5,094,591 A * 3/1992 Whitley et al. ..... 417/234
5,188,516 A * 2/1993 Huang ..... 417/199.1
5,249,930 A * 10/1993 Pacquesi ..... 417/313
5,567,127 A * 10/1996 Wentz ..... 417/312
5,961,293 A * 10/1999 Clemmons et al. ..... 417/44.2
6,173,739 B1 * 1/2001 Addo et al. ..... 137/512.1
6,276,908 B1 * 8/2001 Batchelder et al. ..... 417/423.14
7,264,449 B1 * 9/2007 Harned et al. ..... 417/36
2001/0002597 A1 * 6/2001 Addo et al. ..... 137/512.1
2006/0083630 A1 * 4/2006 Chen ..... 417/313
2010/0047094 A1 * 2/2010 Geremia ..... 417/423.3

* cited by examiner

*Primary Examiner* — John Rivell
*Assistant Examiner* — Minh Le
(74) *Attorney, Agent, or Firm* — Alan Kamrath; Kamrath IP Lawfirm, PA

(57) ABSTRACT

A water inlet unit for an amphibious pump includes a housing having a connecting hole, a first water inlet pipe having a first end connected to the connecting hole and a second end provided with a first water inlet port, a second water inlet pipe having a first end connected to the connecting hole and a second end provided with a second water inlet port, a guide member mounted on the housing and connected to the connecting hole, and a tap detachably locked in the first water inlet port or the second water inlet port. Thus, the water inlet unit has a first water inlet port and a second water inlet port so that the water inlet unit and the amphibious pump are disposed at an upright or transverse state according to the practical space requirement.

18 Claims, 5 Drawing Sheets

WATER INLET UNIT FOR AN AMPHIBIOUS PUMP

BACKGROUND OF THE INVENTION

1. Field of the Invention

The present invention relates to an amphibious pump and, more particularly, to a water inlet unit for an amphibious pump.

2. Description of the Related Art

A conventional amphibious pump comprises a pump body, a motor mounted in the pump body, an impeller module mounted in the pump body and driven by the motor, a water inlet unit mounted on the lower end of the pump body and having a water inlet hole connected to the pump body, and a water outlet port mounted on and connected to the upper portion of the pump body. In operation, the water inlet unit is disposed at an upright state so that the amphibious pump is also disposed at an upright state. In such a manner, when the water inlet unit is placed in a water source, such as a well, pool, reservoir and the like, the water in the water source flows through the water inlet hole into the water inlet unit. Then, the impeller module is driven by the motor to draw water so that the water in the water inlet unit is drawn to flow into the pump body and is drained outward from the water outlet port. Thus, the amphibious pump can be used to pump and draw the water from a lower location, such as a well, pool, reservoir and the like, to a higher location, such as a water tower and the like. However, the amphibious pump is disposed at the upright state only and cannot be disposed at a transverse state so that when the amphibious pump is placed in a shallow water drawing zone or a narrow space, the amphibious pump cannot be operated easily, thereby limiting operation of the amphibious pump and causing inconvenience to the operator.

BRIEF SUMMARY OF THE INVENTION

In accordance with the present invention, there is provided a water inlet unit for an amphibious pump, comprising a housing having an upper portion formed with a connecting hole, a first water inlet pipe mounted in the housing and having a first end connected to the connecting hole of the housing and a second end provided with a first water inlet port, a second water inlet pipe mounted in the housing and having a first end connected to the connecting hole of the housing and a second end provided with a second water inlet port, a guide member mounted on the upper portion of the housing and connected to the connecting hole of the housing, and a tap mounted on the housing and detachably locked in the first water inlet port of the first water inlet pipe or the second water inlet port of the second water inlet pipe.

The second water inlet pipe is connected to the first water inlet pipe. The first water inlet pipe extends in an axial direction of the housing. The second water inlet pipe extends in a radial direction of the housing. The second water inlet pipe is perpendicular to the first water inlet pipe. The first water inlet port of the first water inlet pipe has a peripheral wall provided with a first inner thread. The second water inlet port of the second water inlet pipe has a peripheral wall provided with a second inner thread. The tap has a peripheral wall provided with an outer thread screwed into the first inner thread of the first water inlet port or the second inner thread of the second water inlet port. The guide member has an inner portion formed with a plurality of guide holes each connected to the connecting hole of the housing. The guide member has a peripheral wall provided with an outer threaded portion. The upper portion of the housing has a peripheral wall formed with a plurality of locking slots, and the guide member has a bottom having a peripheral wall provided with a plurality of locking lugs releasably locked in the locking slots of the housing respectively to lock the guide member onto the housing. The water inlet unit further comprises a support base mounted on a lower portion of the housing to support the housing. The support base has a surface formed with a plurality of filtering apertures connected to the first water inlet port of the first water inlet pipe. The filtering apertures of the support base are formed in a peripheral wall and a bottom of the support base. The lower portion of the housing has a peripheral wall formed with an annular retaining groove. The support base has an upper portion having a peripheral wall formed with a plurality of locking hooks locked in the retaining groove of the housing to lock the housing onto the support base. The support base has a lower portion having a peripheral wall formed with a plurality of support legs to support the support base.

According to the primary advantage of the present invention, the water inlet unit comprises a first water inlet pipe having a first water inlet port and a second water inlet pipe having a second water inlet port so that the water inlet unit and the amphibious pump are disposed at an upright state or a transverse state according to the practical space requirement so as to facilitate an operator operating the amphibious pump.

According to another advantage of the present invention, the guide member has an inner portion formed with a plurality of guide holes to increase the water output.

According to a further advantage of the present invention, the filtering apertures of the support base are used to filter granular or larger impurities in the water to protect the impeller module and the pump body.

According to a further advantage of the present invention, the water inlet unit and the amphibious pump can be operated in the water and can also be operated on the land, thereby enhancing the versatility of the amphibious pump.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

Figure 2:
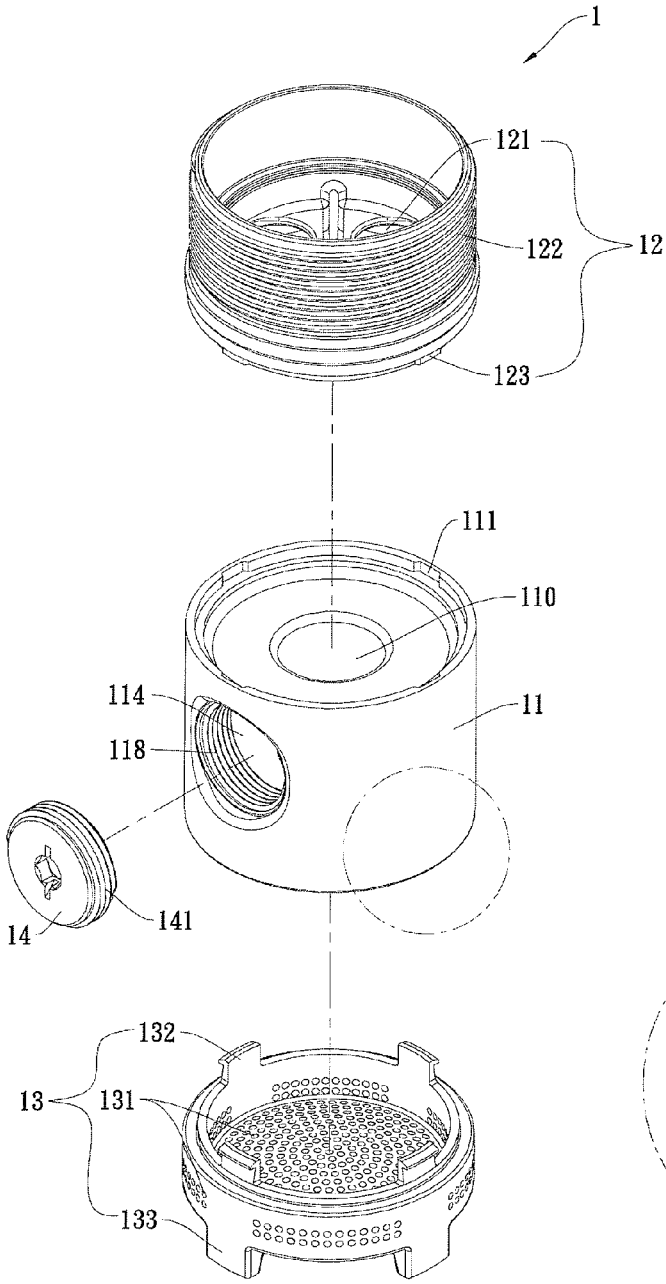
FIG. 2 is an exploded perspective view of the water inlet unit as shown in FIG. 1.
Figure 2A:
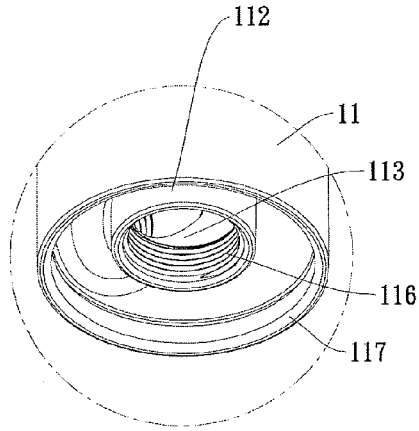

FIG. 2*a* is a locally enlarged view of a housing of the water inlet unit as shown in FIG. 2.

Figure 1:
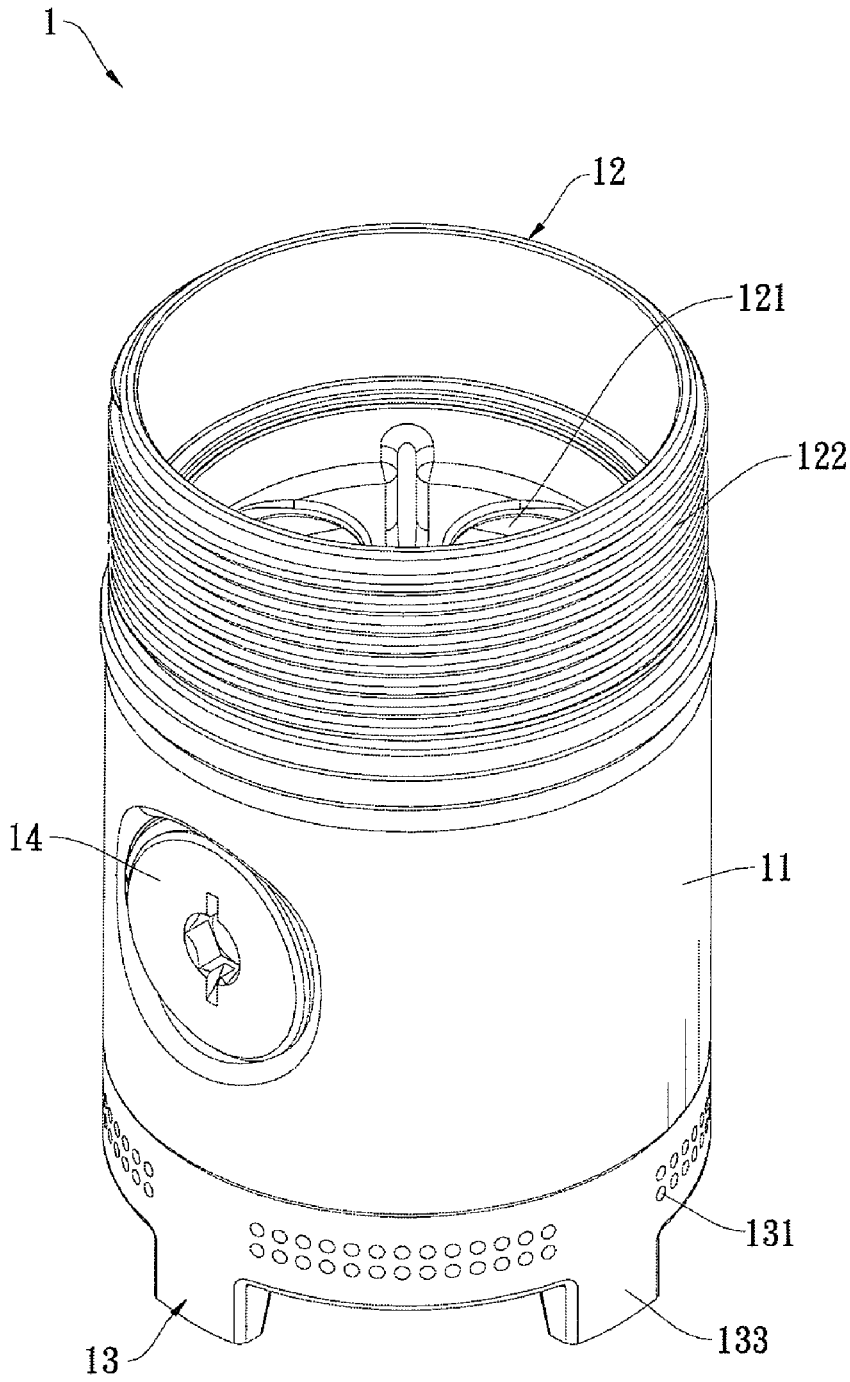
FIG. 1 is a perspective view of a water inlet unit in accordance with the preferred embodiment of the present invention.
Figure 3:
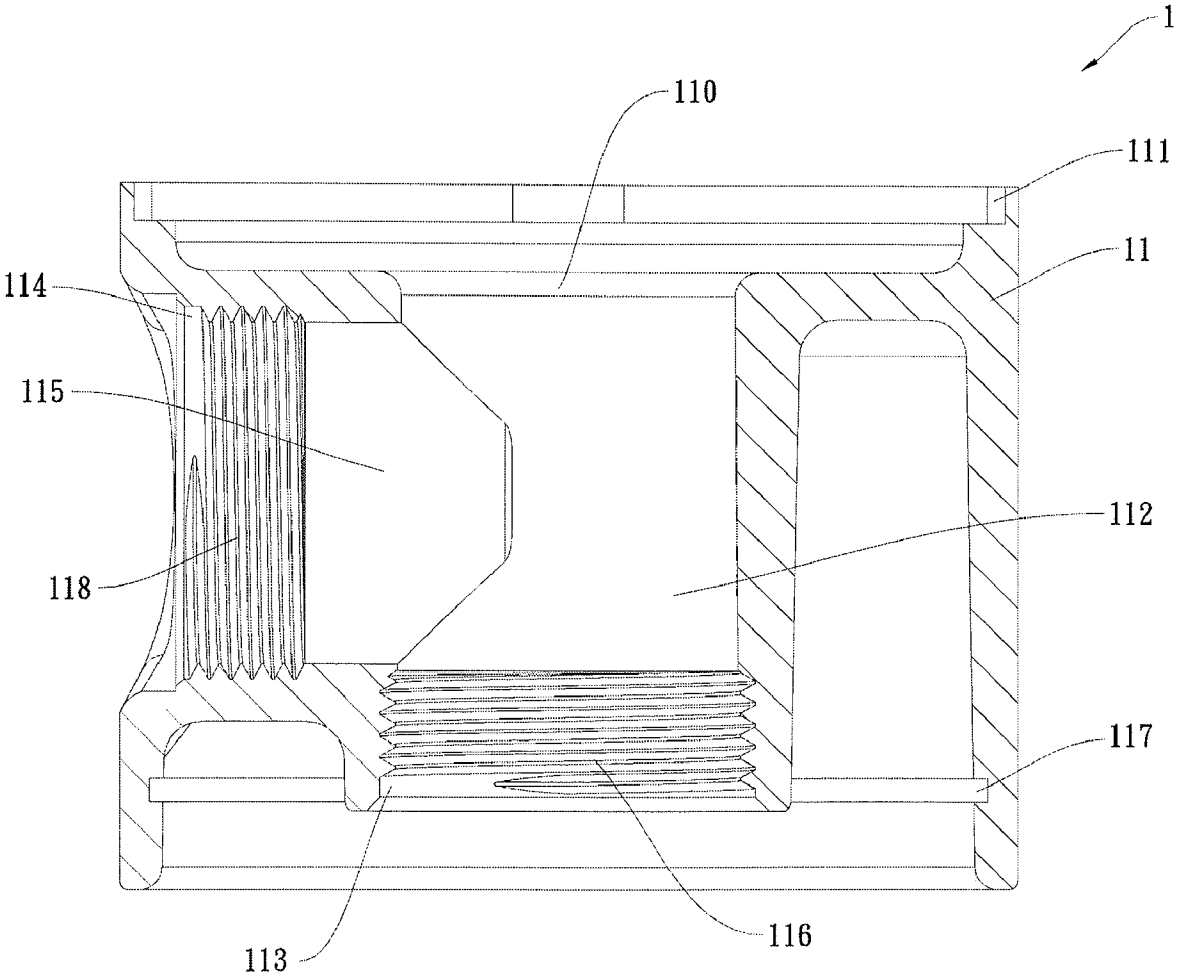

FIG. 3 is a front cross-sectional view of the water inlet unit for an amphibious pump as shown in FIG. 1.

Figure 4:
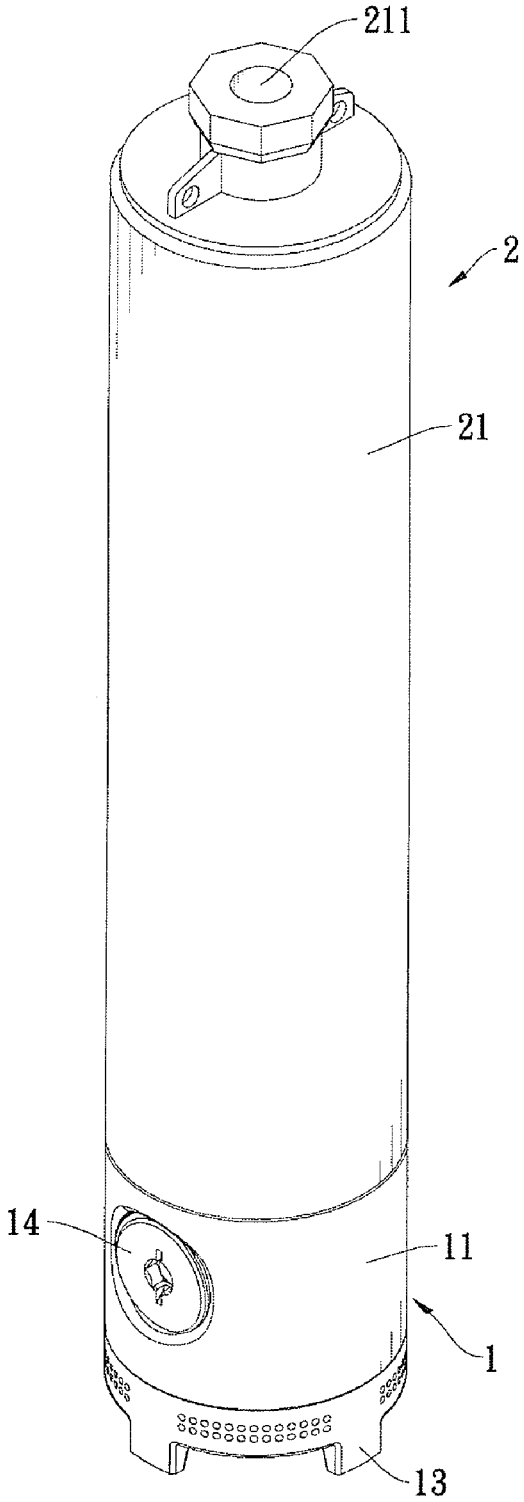

FIG. 4 is a perspective view of the water inlet unit in combination with an amphibious pump in accordance with the preferred embodiment of the present invention.

Figure 5:
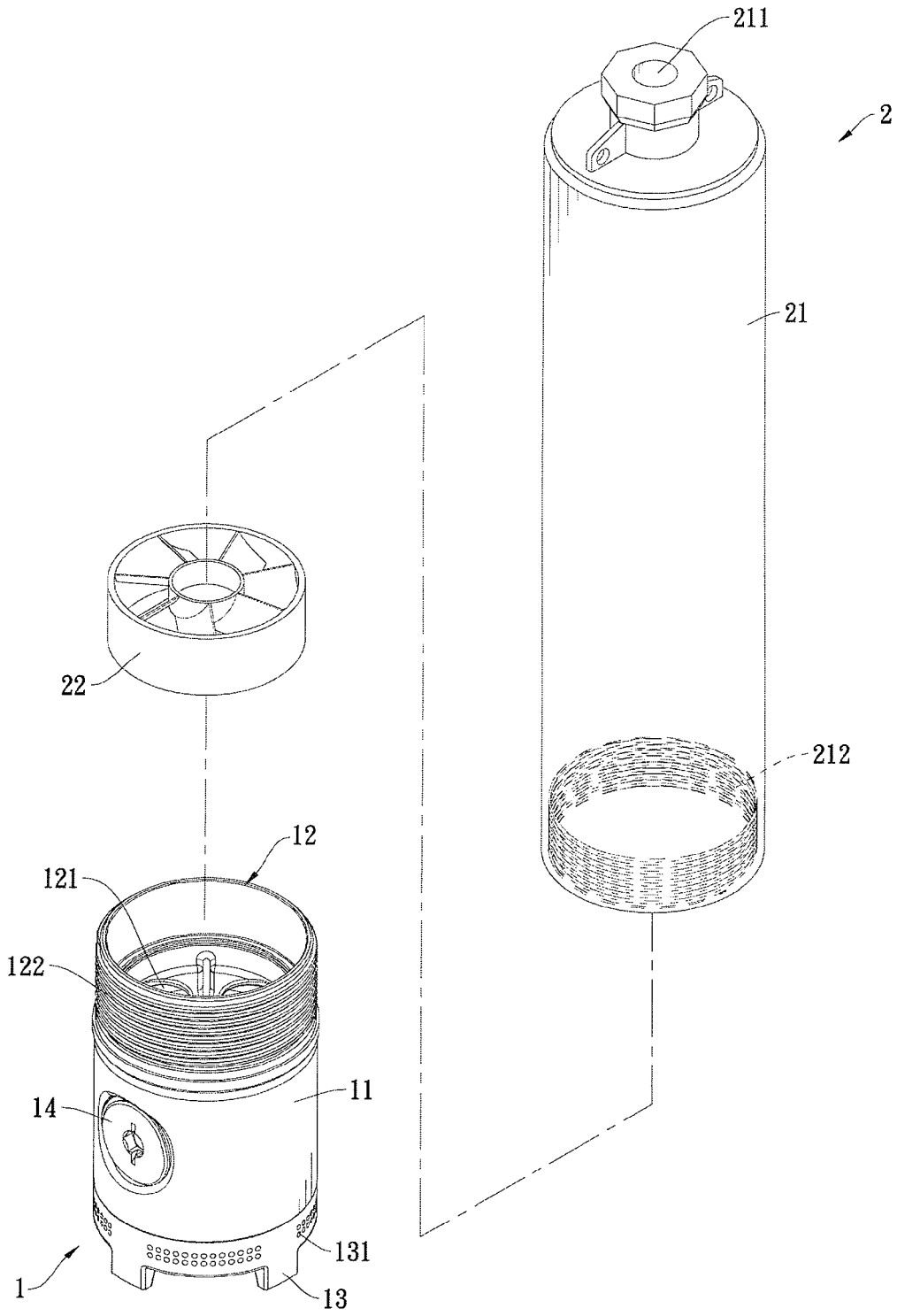

FIG. 5 is an exploded perspective view of the water inlet unit in combination with the amphibious pump as shown in FIG. 4.

DETAILED DESCRIPTION OF THE INVENTION

Referring to the drawings and initially to FIGS. 1-3, a water inlet unit 1 for an amphibious pump in accordance with the preferred embodiment of the present invention comprises a housing 11 having an upper portion formed with a connecting hole 110, a first water inlet pipe 112 mounted in the housing 11 and having a first end connected to the connecting hole 110 of the housing 11 and a second end provided with a first water inlet port 113, a second water inlet pipe 115 mounted in the housing 11 and having a first end connected to the connecting hole 110 of the housing 11 and a second end provided with a second water inlet port 114, a guide member 12 mounted on the upper portion of the housing 11 and connected to the connecting hole 110 of the housing 11, and a tap 14 mounted on the housing 11 and detachably locked in the first water inlet port 113 of the first water inlet pipe 112 or the second water inlet port 114 of the second water inlet pipe 115.

The first water inlet pipe 112 extends in an axial direction of the housing 11. The first water inlet port 113 of the first water inlet pipe 112 has a peripheral wall provided with a first inner thread 116. Preferably, the first water inlet pipe 112 is formed integrally in the housing 11.

The second water inlet pipe 115 is connected to the first water inlet pipe 112. The second water inlet pipe 115 extends in a radial direction of the housing 11 and is perpendicular to the first water inlet pipe 112. The second water inlet port 114 of the second water inlet pipe 115 has a peripheral wall provided with a second inner thread 118. Preferably, the second water inlet pipe 115 is formed integrally in the housing 11.

The tap 14 has a peripheral wall provided with an outer thread 141 screwed into the first inner thread 116 of the first water inlet port 113 or the second inner thread 118 of the second water inlet port 114.

The guide member 12 is located above the connecting hole 110 of the housing 11. The guide member 12 has an inner portion formed with a plurality of guide holes 121 each connected to the connecting hole 110 of the housing 11. The guide member 12 has a peripheral wall provided with an outer threaded portion 122. The guide member 12 has a bottom having a peripheral wall provided with a plurality of locking lugs 123.

The housing 11 has a substantially cylindrical shape. The connecting hole 110 of the housing 11 is connected between the guide holes 121 of the guide member 12 and the first water inlet pipe 112 and is connected between the guide holes 121 of the guide member 12 and the second water inlet pipe 115. The upper portion of the housing 11 has a peripheral wall formed with a plurality of locking slots 111, and the locking lugs 123 of the guide member 12 are releasably locked in the locking slots 111 of the housing 11 respectively to lock the guide member 12 onto the housing 11. The housing 11 has a lower portion having a peripheral wall formed with an annular retaining groove 117.

The water inlet unit 1 further comprises a support base 13 mounted on the lower portion of the housing 11 to support the housing 11. The support base 13 is located under the first water inlet pipe 112 and is connected to the first water inlet port 113 of the first water inlet pipe 112. The support base 13 has a substantially cylindrical shape and has a surface formed with a plurality of filtering apertures 131 connected to the first water inlet port 113 of the first water inlet pipe 112. Preferably, the filtering apertures 131 of the support base 13 are formed in a peripheral wall and a bottom of the support base 13. The support base 13 has an upper portion having a peripheral wall formed with a plurality of locking hooks 132 locked in the retaining groove 117 of the housing 11 to lock the housing 11 onto the support base 13. The support base 13 has a lower portion having a peripheral wall formed with a plurality of support legs 133 to support the support base 13.

Referring to FIGS. 4 and 5 with reference to FIGS. 1-3, the water inlet unit 1 is combined with an amphibious pump 2. The amphibious pump 2 comprises a pump body 21 mounted on the guide member 12 of the water inlet unit 1, a motor (not shown) mounted in the pump body 21, an impeller module 22 mounted in the pump body 21 and driven by the motor, and a water outlet port 211 mounted on an upper portion of the pump body 21. The pump body 21 of the amphibious pump 2 has a lower portion formed with an inner threaded portion 212 screwed onto the outer threaded portion 122 of the guide member 12 to attach the pump body 21 of the amphibious pump 2 to the guide member 12 of the water inlet unit 1.

In operation, referring to FIGS. 1-5, the water inlet unit 1 is disposed at an upright state so that the amphibious pump 2 is also disposed at an upright state as shown in FIG. 4. At this time, the tap 14 is locked in the second water inlet port 114 of the second water inlet pipe 115 so that only the first water inlet pipe 112 is connected to the connecting hole 110 of the housing 11. In such a manner, when the water inlet unit 1 is placed in a water source, such as a well, pool, reservoir and the like, the water in the water source flows through the first water inlet port 113 of the first water inlet pipe 112 into the water inlet unit 1 and then passes through the first water inlet pipe 112, the connecting hole 110 of the housing 11 and the guide holes 121 of the guide member 12 into the guide member 12. Then, the impeller module 22 is driven by the motor to draw water so that the water in the guide member 12 of the water inlet unit 1 is drawn to flow into the pump body 21 and is drained outward from the water outlet port 211. Thus, the amphibious pump 2 can be used to pump and draw the water from a lower location, such as a well, pool, reservoir and the like, to a higher location, such as a water tower and the like. At this time, the support base 13 is mounted on the lower portion of the housing 11 to support the housing 11, and the filtering apertures 131 of the support base 13 are used to filter granular or larger impurities in the water to prevent the impeller module 22 from being worn out due to hit.

Alternatively, the water inlet unit 1 is disposed at a transverse state so that the amphibious pump 2 is also disposed at a transverse state. At this time, the support base 13 is removed from the housing 11, and the tap 14 is locked in the first water inlet port 113 of the first water inlet pipe 112 so that only the second water inlet pipe 115 is connected to the connecting hole 110 of the housing 11. In such a manner, the water in the water source flows through the second water inlet port 114 of the second water inlet pipe 115 into the water inlet unit 1 and then passes through the second water inlet pipe 115, the connecting hole 110 of the housing 11 and the guide holes 121 of the guide member 12 into the guide member 12. Then, the impeller module 22 is driven by the motor to draw water so that the water in the guide member 12 of the water inlet unit 1 is drawn to flow into the pump body 21 and is drained outward from the water outlet port 211.

Alternatively, when the water inlet unit 1 is placed on the land, the water inlet unit 1 further comprises a connecting hose (not shown) having a first end connected to the first water inlet port 113 of the first water inlet pipe 112 or the second water inlet port 114 of the second water inlet pipe 115 and a second end connected to a water drawing zone on the land, such as an aquarium and the like, so that the amphibious pump 2 can be used to pump the water in the water drawing zone on the land.

Accordingly, the water inlet unit 1 comprises a first water inlet pipe 112 having a first water inlet port 113 and a second water inlet pipe 115 having a second water inlet port 114 so that the water inlet unit 1 and the amphibious pump 2 are disposed at an upright state or a transverse state according to the practical space requirement so as to facilitate an operator operating the amphibious pump 2. In addition, the guide member 12 has an inner portion formed with a plurality of guide holes 121 to increase the water output. Further, the filtering apertures 131 of the support base 13 are used to filter granular or larger impurities in the water to protect the impeller module 22 and the pump body 21. Further, the water inlet unit 1 and the amphibious pump 2 can be operated in the water and can also be operated on the land, thereby enhancing the versatility of the amphibious pump 2.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A water inlet unit for an amphibious pump, comprising:

a housing having an upper portion formed with a connecting hole;

a first water inlet pipe mounted in the housing and having a first end connected to the connecting hole of the housing and a second end provided with a first water inlet port;

a second water inlet pipe mounted in the housing and having a first end connected to the connecting hole of the housing and a second end provided with a second water inlet port;

a guide member mounted on the upper portion of the housing and connected to the connecting hole of the housing; and a tap mounted on the housing and detachably locked in the first water inlet port of the first water inlet pipe or the second water inlet port of the second water inlet pipe.

2. The water inlet unit for an amphibious pump of claim 1, wherein the second water inlet pipe is connected to the first water inlet pipe.

3. The water inlet unit for an amphibious pump of claim 1, wherein the first water inlet pipe extends in an axial direction of the housing;

the second water inlet pipe extends in a radial direction of the housing.

4. The water inlet unit for an amphibious pump of claim 3, wherein the second water inlet pipe is perpendicular to the first water inlet pipe.

5. The water inlet unit for an amphibious pump of claim 1, wherein the first water inlet port of the first water inlet pipe has a peripheral wall provided with a first inner thread;

the second water inlet port of the second water inlet pipe has a peripheral wall provided with a second inner thread;

the tap has a peripheral wall provided with an outer thread screwed into the first inner thread of the first water inlet port or the second inner thread of the second water inlet port.

6. The water inlet unit for an amphibious pump of claim 1, wherein the guide member has an inner portion formed with a plurality of guide holes each connected to the connecting hole of the housing.

7. The water inlet unit for an amphibious pump of claim 1, wherein the guide member has a peripheral wall provided with an outer threaded portion.

8. The water inlet unit for an amphibious pump of claim 1, wherein the upper portion of the housing has a peripheral wall formed with a plurality of locking slots; and the guide member has a bottom having a peripheral wall provided with a plurality of locking lugs releasably locked in the locking slots of the housing respectively to lock the guide member onto the housing.

9. The water inlet unit for an amphibious pump of claim 1, wherein the water inlet unit further comprises a support base mounted on a lower portion of the housing to support the housing.

10. The water inlet unit for an amphibious pump of claim 9, wherein the support base has a surface formed with a plurality of filtering apertures connected to the first water inlet port of the first water inlet pipe.

11. The water inlet unit for an amphibious pump of claim 10, wherein the filtering apertures of the support base are formed in a peripheral wall and a bottom of the support base.

12. The water inlet unit for an amphibious pump of claim 9, wherein the lower portion of the housing has a peripheral wall formed with an annular retaining groove;

the support base has an upper portion having a peripheral wall formed with a plurality of locking hooks locked in the retaining groove of the housing to lock the housing onto the support base.

13. The water inlet unit for an amphibious pump of claim 9, wherein the support base has a lower portion having a peripheral wall formed with a plurality of support legs to support the support base.

14. The water inlet unit for an amphibious pump of claim 9, wherein the support base is located under the first water inlet pipe;

the support base is connected to the first water inlet port of the first water inlet pipe.

15. The water inlet unit for an amphibious pump of claim 9, wherein the support base has a substantially cylindrical shape.

16. The water inlet unit for an amphibious pump of claim 1, wherein the first water inlet pipe is formed integrally in the housing;

the second water inlet pipe is formed integrally in the housing.

17. The water inlet unit for an amphibious pump of claim 1, wherein the guide member is located above the connecting hole of the housing;

the connecting hole of the housing is connected between the guide holes of the guide member and the first water inlet pipe;

the connecting hole of the housing is connected between the guide holes of the guide member and the second water inlet pipe.

18. The water inlet unit for an amphibious pump of claim 6, wherein the housing has a substantially cylindrical shape.

* * * * *